US010100793B2

(12) United States Patent
Ohta et al.

(10) Patent No.: US 10,100,793 B2
(45) Date of Patent: Oct. 16, 2018

(54) INTAKE SOUND REDUCTION DEVICE FOR INTERNAL COMBUSTION ENGINE

(71) Applicant: MAHLE FILTER SYSTEMS JAPAN CORPORATION, Tokyo (JP)

(72) Inventors: Katsuhisa Ohta, Kawagoe (JP); Yuichi Kato, Fujimino (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 50 days.

(21) Appl. No.: 15/299,809

(22) Filed: Oct. 21, 2016

(65) Prior Publication Data

US 2017/0175690 A1 Jun. 22, 2017

(30) Foreign Application Priority Data

Dec. 18, 2015 (JP) ..... 2015-247481

(51) Int. Cl.
*F02M 35/12* (2006.01)
*G10K 11/16* (2006.01)
(Continued)

(52) U.S. Cl.
CPC .... *F02M 35/1266* (2013.01); *F02M 35/1222* (2013.01); *F02M 35/1238* (2013.01);
(Continued)

(58) Field of Classification Search
CPC ..... F02M 35/1266; F02M 35/1222; F02M 35/1238; F02M 35/1261; F02M 35/1277
(Continued)

(56) References Cited

U.S. PATENT DOCUMENTS

2002/0000343 A1* 1/2002 Paschereit ..... F01N 1/02 181/229
2009/0236171 A1* 9/2009 Yokoya ..... F02M 35/10295 181/160
(Continued)

FOREIGN PATENT DOCUMENTS

EP 1 365 120 A1 11/2003
JP 2013-124599 A 6/2013
(Continued)

OTHER PUBLICATIONS

English translation of JP 2013-124599; accessed Feb. 2, 2018; <https://www4.j-platpat.inpit.go.jp/cgi-bin/tran_web_cgi_ejje?u=http://www4.j-platpat.inpit.go.jp/eng/translation/201802030610550171751668385274730959 4DF236169CAE91AFE60A5A76217973>.*
European Extended Search Report, dated Feb. 27, 2017, 6 pages.

*Primary Examiner* — Jeremy Luks
(74) *Attorney, Agent, or Firm* — Foley & Lardner LLP

(57) ABSTRACT

Intake sound reduction device for internal combustion engine includes an elastic member formed into substantially cylindrical shape and having an open base end, a top end sealed by an end surface wall and a bellows circumferential wall; a base plate retaining base end of elastic member; and a communication pipe whose one end is connected to base plate so that a volume chamber formed inside elastic member communicates with an intake passage of the engine. Intake sound reduction device has first resonance system formed by expansion and contraction in axial direction of elastic member and second resonance system formed by film-vibration of end surface wall. When either one of resonance frequencies of the first and second resonance systems is primary resonance frequency and the other is secondary resonance frequency, the primary resonance frequency is set to 30~200 Hz and the secondary resonance frequency is set to 50~300 Hz.

4 Claims, 7 Drawing Sheets

(51) Int. Cl.
*G10K 11/172* (2006.01)
*F01N 1/02* (2006.01)
*F01N 1/22* (2006.01)

(52) U.S. Cl.
CPC .... *F02M 35/1261* (2013.01); *F02M 35/1277* (2013.01); *G10K 11/161* (2013.01); *G10K 11/172* (2013.01); *F01N 1/023* (2013.01); *F01N 1/22* (2013.01)

(58) Field of Classification Search
USPC ..... 181/229
See application file for complete search history.

(56) References Cited

U.S. PATENT DOCUMENTS

| | | | | |
|---|---|---|---|---|
| 2011/0315472 | A1* | 12/2011 | Ohta | F02M 35/10295 181/157 |
| 2015/0361934 | A1 | 12/2015 | Arteaga et al. | |
| 2016/0230719 | A1* | 8/2016 | Kato | F02M 35/1261 |

FOREIGN PATENT DOCUMENTS

| | | | |
|---|---|---|---|
| JP | 2014-31753 | A | 2/2014 |
| JP | 2014-105666 | A | 6/2014 |

* cited by examiner

INTAKE SOUND REDUCTION DEVICE FOR INTERNAL COMBUSTION ENGINE

BACKGROUND OF THE INVENTION

The present invention relates to an intake sound reduction device that reduces an intake sound of an internal combustion engine, and more particularly to an intake sound reduction device having an elastically deformable bellows volume chamber.

Japanese Unexamined Patent Publication No. 2013-124599 (hereinafter is referred to as "JP2013-124599") discloses an intake sound reduction device for an internal combustion engine, which is a new type of intake sound reduction device proposed by an applicant of the present invention. This intake sound reduction device is configured so that a volume chamber is defined by an elastic member formed by an elastically deformable bellows, and this volume chamber is connected to an intake duct of the internal combustion engine via a communication pipe that is a main pipe of Helmholtz resonant element. The elastic member is accommodated in a cylindrical case that is open to the air.

SUMMARY OF THE INVENTION

The intake sound reduction device disclosed in JP2013-124599 can reduce an intake sound of a specific frequency band by a working or effect of the Helmholtz resonant element formed by connecting the volume chamber to the intake duct via the main pipe. In addition to this reduction of the intake sound, since the bellows elastic member expands and contracts in response to an intake pulsation and thus a sound pressure energy is reduced, an intake sound of a second specific frequency band can also be reduced.

Here, in related arts or in JP2013-124599, an end surface wall of a top end (a free end) of the bellows elastic member is treated as an element corresponding to a mass of a spring-mass system that is a resonance system (a vibration system or an oscillation system) formed by the bellows elastic member, and it has been thought that it is desirable for the end surface wall to be formed by a rigid body. However, the applicant of the present invention carried out a further research and found out that by actively using the end surface wall as a second resonance system (a second vibration system or a second oscillation system) that produces film-vibration and by setting a resonance frequency of a first resonance system by the expansion and contraction of the bellows elastic member and a resonance frequency of a second resonance system by the film-vibration of the end surface wall to be relatively close to each other, a greater intake sound reduction can be obtained in an antiresonance region between the both resonance frequencies. That is, the intake sound reduction device disclosed in JP2013-124599 and the related art intake sound reduction devices still have plenty of room for improvement in reduction of the intake sound.

An object of the present invention is therefore to provide an intake sound reduction device that is capable of improving an intake sound reduction effect.

According to one aspect of the present invention, an intake sound reduction device for an internal combustion engine comprises: an elastic member formed into a substantially cylindrical shape, the elastic member having an open base end, a top end sealed by an end surface wall and a bellows circumferential wall; a base plate retaining the base end of the elastic member; and a communication pipe whose one end is connected to the base plate so that a volume chamber that is formed inside the elastic member communicates with an intake passage of the internal combustion engine. And, the intake sound reduction device has a first resonance system formed by expansion and contraction in an axial direction of the elastic member and a second resonance system formed by film-vibration of the end surface wall, and when either one of resonance frequencies of the first and second resonance systems is a primary resonance frequency and the other is a secondary resonance frequency, the primary resonance frequency is set to 30~200 Hz and the secondary resonance frequency set to 50~300 Hz.

As one preferable aspect of the present invention, a separation between the primary resonance frequency and the secondary resonance frequency is set to 15~200 Hz.

With the above structure or configuration, the intake sound is reduced by antiresonance between the primary resonance frequency by either one of the resonance frequencies of the first and second resonance systems and the secondary resonance frequency by the other. That is, it is possible to consume energy of the intake sound by the antiresonance.

In order for the two resonance systems to have the respective resonance frequencies that are relatively close to each other, it is desirable that the end surface wall and the circumferential wall should be formed with the same elastic material.

As one preferable aspect of the present invention, the end surface wall is formed by a synthetic resin plate, and the end surface wall is supported at a tip end outer circumferential portion of the circumferential wall made of elastic material through an edge portion that is formed at the tip end outer circumferential portion of the circumferential wall with elastic material and has an arc shape in a longitudinal cross section.

According to the present invention, by actively using the end surface wall of the top end of the bellows elastic member as the resonance system, it is possible to effectively reduce the intake sound of the internal combustion engine by the antiresonance between the two resonance frequencies.

The other objects and features of this invention will become understood from the following description with reference to the accompanying drawings.

DETAILED DESCRIPTION OF THE INVENTION

Embodiments of the present invention will be explained below with reference to the drawings.

Figure 1:
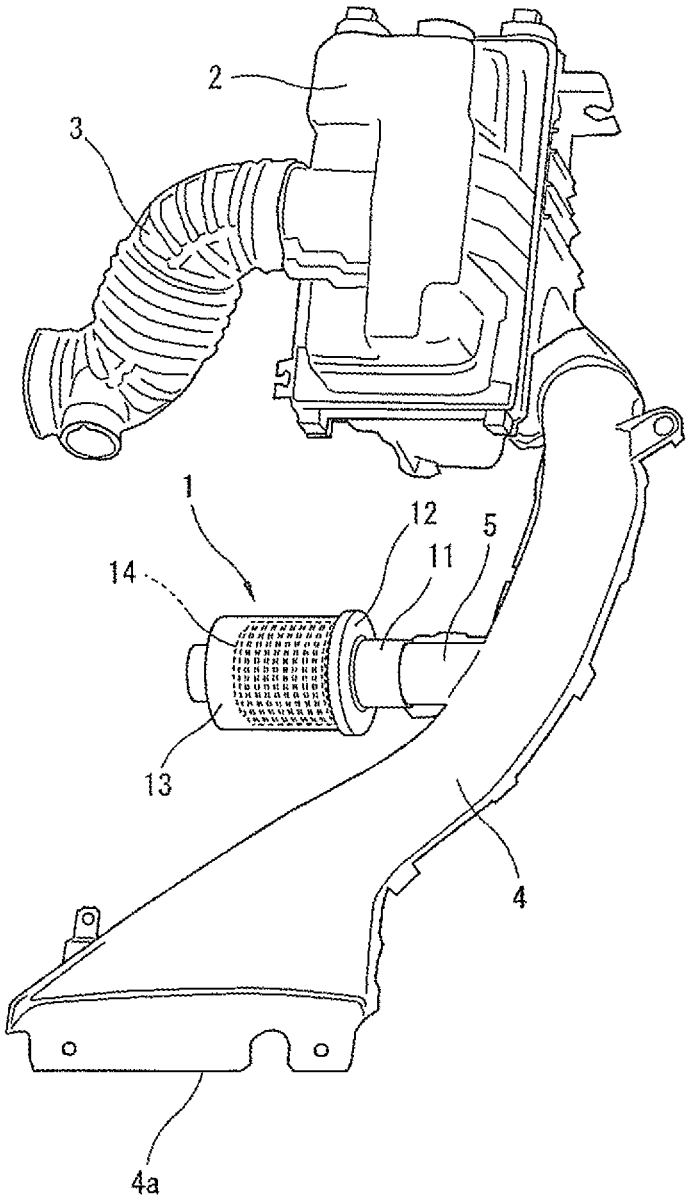
FIG. 1 is a perspective view showing an intake system, having an intake sound reduction device of the present invention, of an internal combustion engine.

FIG. 1 shows an intake system, having an intake sound reduction device 1 of the present invention, of an internal combustion engine for a vehicle. An air cleaner 2 having therein an air cleaner element is connected to the internal combustion engine (not shown) via a flexible intake duct 3 with a downstream side (a clean side) of the cleaner element of the air cleaner 2 being connected to the intake duct 3. An outside air introduction duct 4 formed by a molded-hard synthetic resin is connected to an upstream side (a dust side) of the cleaner element of the air cleaner 2. A top end of the outside air introduction duct 4 is open as an outside air introduction port 4*a*, and an outside air introduced from this outside air introduction port 4*a* passes through the air cleaner 2 and is introduced into the internal combustion engine via the intake duct 3.

In this embodiment, the intake sound reduction device 1 is connected to a side surface of the outside air introduction duct 4 forming a part of an intake passage from the outside air introduction port 4*a* to the internal combustion engine, and reduces an intake sound (such as a pulsation sound caused by pulsation of an intake air and an airflow sound caused by flow of the intake air) that leaks or is released from the outside air introduction port 4*a* to the outside. More specifically, a branch pipe 5 is provided at the synthetic resin-made outside air introduction duct 4 so as to branch off from the outside air introduction duct 4 in a direction substantially orthogonal to a main flow of the intake air, and the intake sound reduction device 1 is connected to this branch pipe 5.

Figure 2:
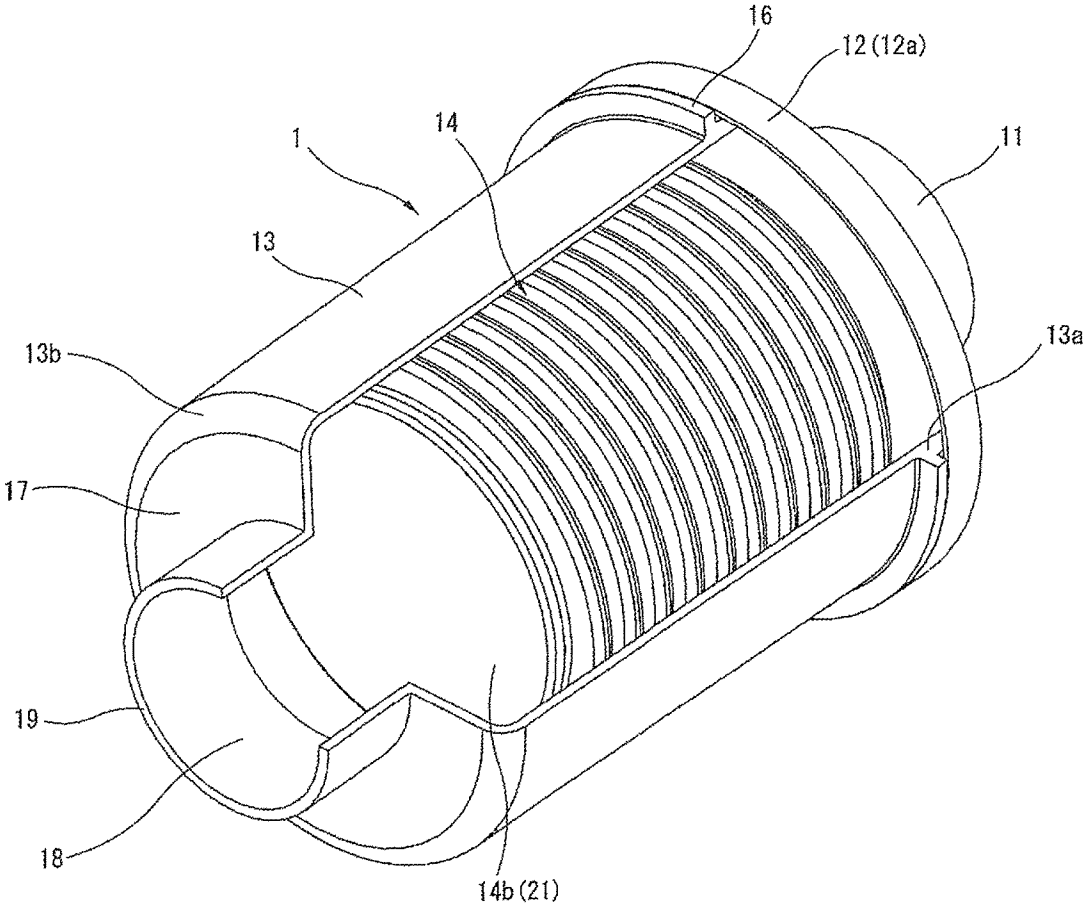
FIG. 2 is a perspective view showing the intake sound reduction device with a part of a case being cut out.

The intake sound reduction device 1 is formed, as shown in FIG. 2, mainly by a circular base plate 12 (more specifically, an annular base plate 12) having at a middle thereof a communication pipe 11 that is fitted and secured to the branch pipe 5, a cylindrical case 13 whose one end 13*a* is fitted and secured to the base plate 12, and a bellows elastic member 14 accommodated in the case 13.

For instance, the base plate 12 is molded integrally with the communication pipe 11 with hard synthetic resin, and as can be seen in FIG. 2, the one end 13*a* of the case 13 is fitted to an inner circumference of an outer peripheral portion 12*a* that stands or extends in an axial direction of the intake sound reduction device 1. The communication pipe 11 is a pipe that forms, together with the branch pipe 5, a main pipe of so-called Helmholtz resonant element. A pipe length and a bore of the communication pipe 11 in a connected state with the branch pipe 5 are set according to a predetermined resonance frequency.

The case 13 is formed, for instance, with a molded-hard synthetic resin. The case 13 has, at a one end 13*a* side where the case 13 is fitted to the inner circumference of the outer peripheral portion 12*a* of the base plate 12, an annular flange portion 16 for making positioning of the case 13 by contact with the outer peripheral portion 12*a* in the axial direction. The case 13 also has, at the other end 13*b*, an end wall 17. This end wall 17 covers an outer peripheral side portion of the case 13 along a surface orthogonal to the axial direction of the case 13. However, a middle of the other end 13*b* opens as an circular communication opening 18. Therefore, an inside of the case 13 is open to the air through the communication opening 18. The communication opening 18 is encircled with a relatively-short cylindrical portion 19 that extends from the end wall 17. Here, this case 13 is a case for protecting the elastic member 14 against external contact, and thus the case 13 is not necessary as the intake sound reduction device.

Figure 3:
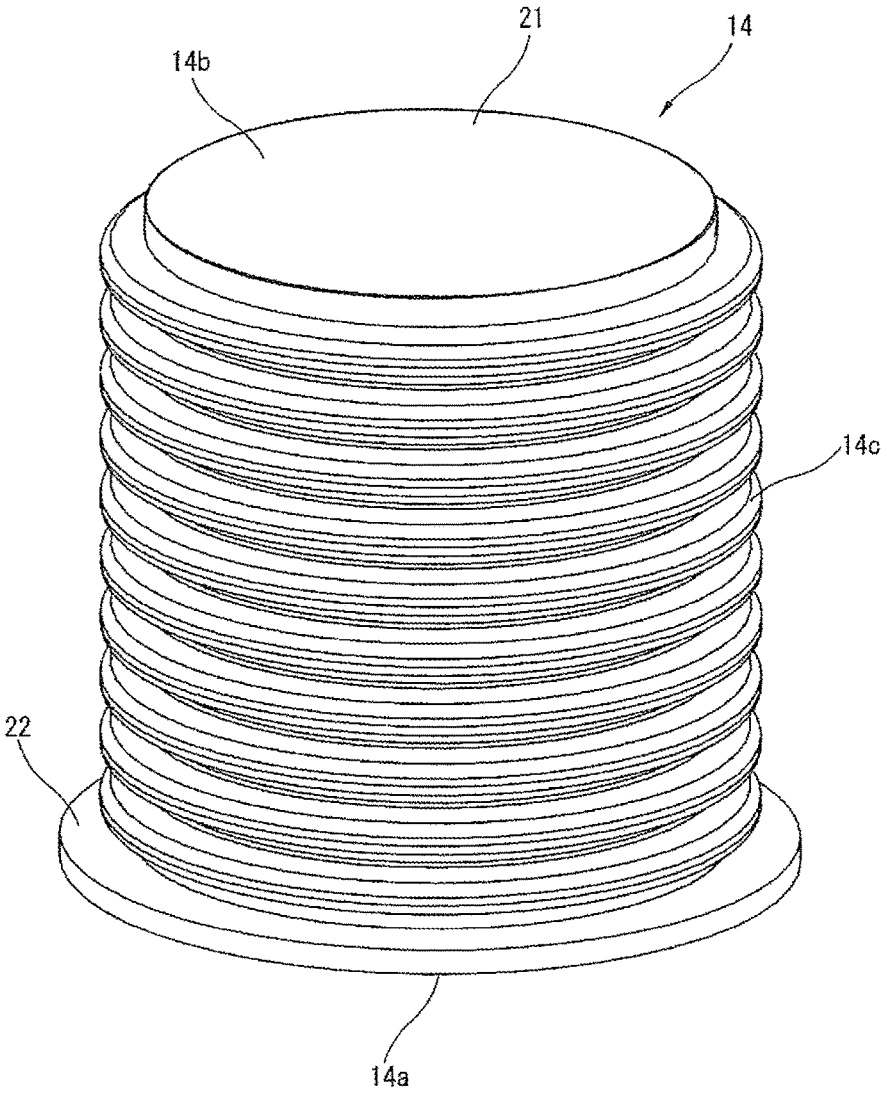
FIG. 3 is a perspective view showing an elastic member.
Figure 4:
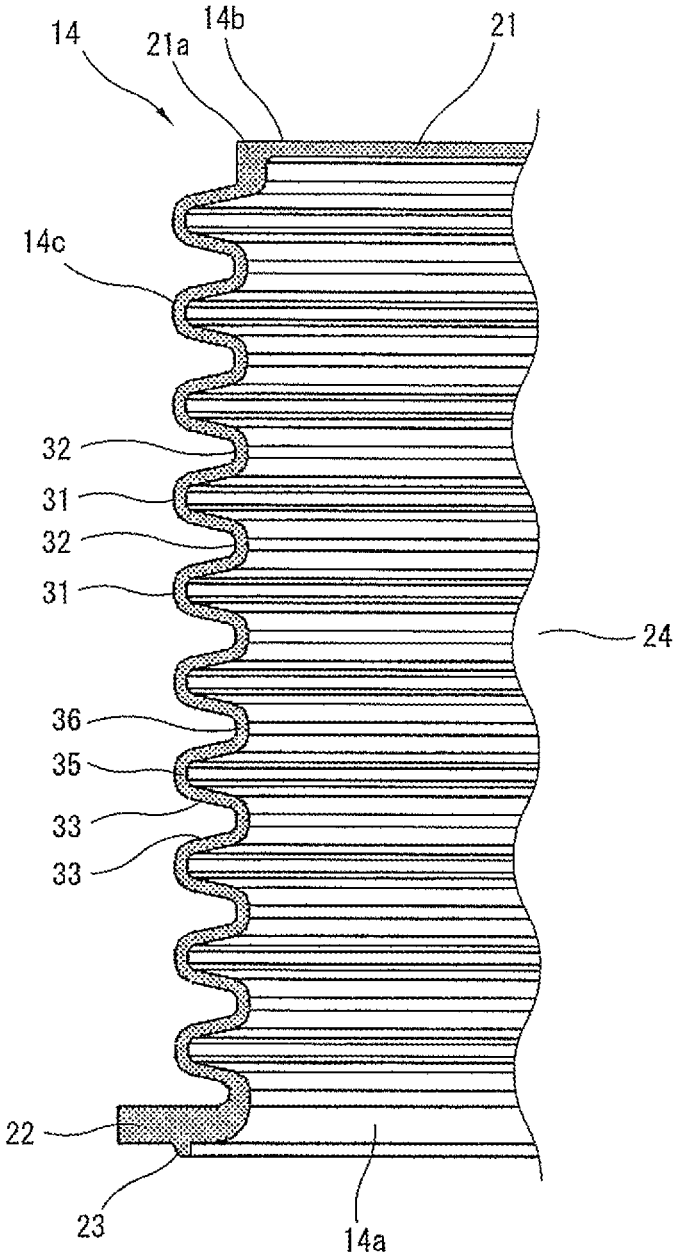
FIG. 4 is a sectional view of the elastic member.

As shown in FIGS. 3 and 4, the elastic member 14 has an open base end 14*a*, a closed or sealed top end 14*b* and a circumferential wall 14*c* having bellows by bending. The elastic member 14 is substantially cylindrical in shape. The elastic member 14 is a member that is formed as an integral component (as a single component) with rubber or elastomer having appropriate elasticity, e.g. thermoplastic elastomer. The top end 14*b*, which is a closed or sealed end, is formed as an end surface wall 21 having a flat circular plate shape. In this embodiment, the end surface wall 21 is formed integrally with the circumferential wall 14*c* with the thermoplastic elastomer that is the same material as that of the circumferential wall 14*c*. A thickness and a rigidity of the end surface wall 21 are set so as to be able to produce so-called film-vibration.

The elastic member 14 is provided with a relatively-thick annular fixing flange 22 at the base end 14*a* which is an open base end. The fixing flange 22 has an outside diameter that is relatively tightly fitted to an inner side of the outer peripheral portion 12*a* of the base plate 12. The fixing flange 22 is sandwiched and held by and between the base plate 12 and the one end 13*a* of the case 13, thereby securing the elastic member 14 to the base plate 12. A seal protrusion 23 is formed on a contact surface of the fixing flange 22 with the base plate 12.

In a state in which the elastic member 14 is secured to the base plate 12, a volume chamber 24 formed inside the elastic member 14 is a hermetic space that is interrupted from an inside space of the case 13, while the volume chamber 24 communicates with the intake passage in the outside air introduction duct 4 through the communication pipe 11 of the base plate 12.

An outside diameter of the circumferential wall 14*c* of the elastic member 14 is set to be slightly smaller than an inside diameter of the case 13. The top end 14*b* of the elastic member 14 is positioned properly away from the end wall 17 of the case 13. Consequently, the elastic member 14 can freely move (expand and contract) in the case 13 with the base end 14*a* secured to the base plate 12 and with the top end 14*b* being a free end.

Figure 5:
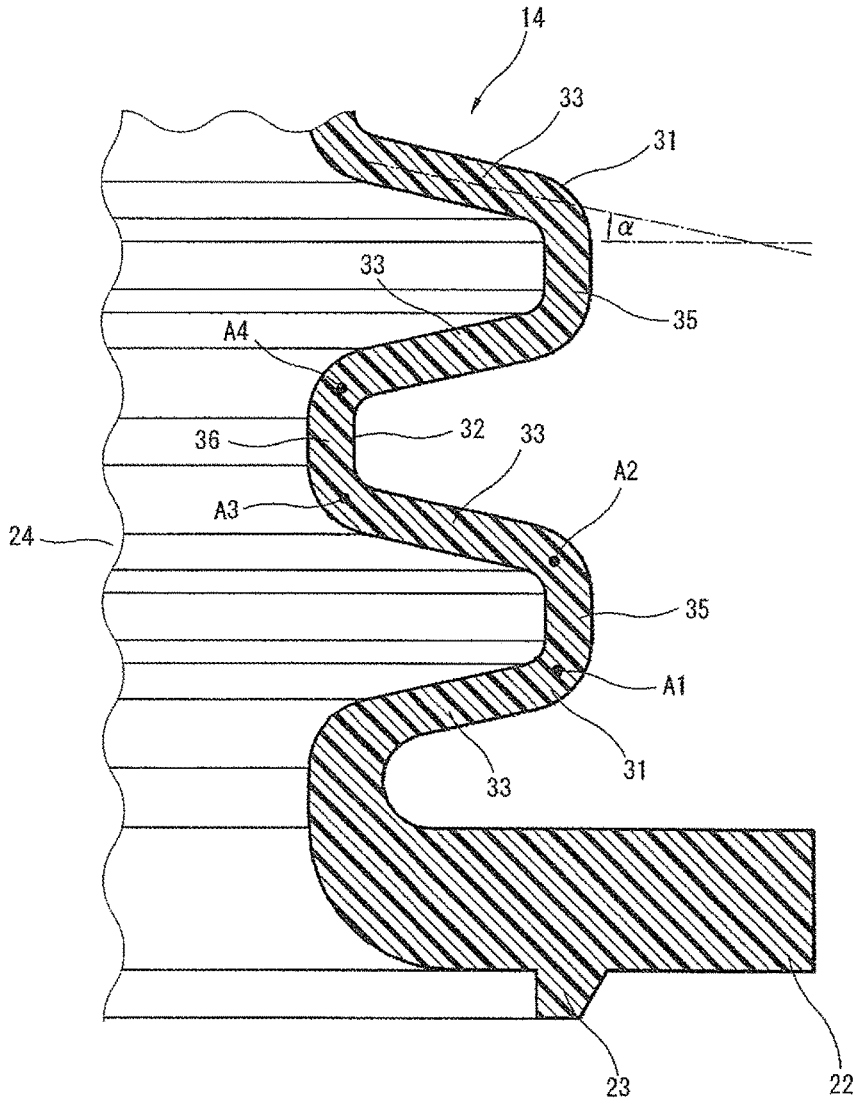
FIG. 5 is an enlarged sectional view of a main part of the elastic member.

FIGS. 4 and 5 show an example of a structure of the circumferential wall 14*c*. As shown in FIG. 4, in this embodiment, the elastic member 14 is formed into a bellows shape by an alternate arrangement of n mountain portions 31 (for instance, 10 mountain portions (i.e. n=10)) and (n−1) valley portions 32 (for instance, 9 valley portions) between the fixing flange 22 and the end surface wall 21. Each of the n mountain portions 31 has the same shape in a longitudinal cross section, and each of the (n−1) valley portions 32 has the same shape in a longitudinal cross section. As can be seen in FIG. 5 showing an enlarged elastic member 14, adjacent mountain portion 31 and valley portion 32 are joined or united together by a tapered wall 33 that inclines with respect to a center axis of the elastic member 14. This tapered wall 33 extends straight in the longitudinal cross section. Since the elastic member 14 is a body of revolution which is a shape formed by rotating the longitudinal cross section shape as shown in FIGS. 4 and 5 on the center axis of the elastic member 14, strictly speaking, the tapered wall 33 is a narrow ring-shaped circular conical surface. When focusing on one mountain portion 31, a pair of tapered walls 33 exist at both upper and lower sides of the one mountain portion 31, and these two tapered walls 33 are symmetrical about the one mountain portion 31.

A peak portion of the mountain portion 31 is formed as a straight line portion 35 that is parallel to the center axis of the elastic member 14. Likewise, a peak portion of the valley portion 32 is formed as a straight line portion 36 that is parallel to the center axis of the elastic member 14. That is, as shown in FIG. 5, the mountain portion 31 is bent at A1 point and at A2 point in the longitudinal cross section, and the mountain portion 31 including the two tapered walls 33 at the both sides forms a trapezoidal shape in the longitudinal cross section. Likewise, the valley portion 32 is bent at A3 point and at A4 point in the longitudinal cross section, and the valley portion 32 including the two tapered walls 33 at the both sides forms a trapezoidal shape in the longitudinal cross section. When viewing these mountain portion 31 and valley portion 32 in the longitudinal cross section, the trapezoidal shape of the mountain portion 31 and the trapezoidal shape of the valley portion 32 are identical with each other. Here, except for the fixing flange 22, a thickness of each part of the circumferential wall 14*c* is basically constant.

Here, in order for the movement (expansion and contraction) or vibration in the axial direction of the elastic member 14 to easily occur, it is desirable that an inclination angle $\alpha$ (an angle with respect to a plane orthogonal to the center axis of the elastic member 14) of the tapered wall 33 should be a relatively small angle, for instance, it is 25° or smaller.

With the above structure of the circumferential wall 14*c* of the elastic member 14, since each of the straight line portion 35 of the mountain portion 31 and the straight line portion 36 of the valley portion 32 forms a cylindrical structure when viewed as a three-dimensional shape although both lengths of the straight line portions 35 and 36 are short, the straight line portions 35 and 36 are hard to deform in a radial direction. That is, these straight line portions 35 and 36 are high rigidity portions by which a rigidity in the radial direction of the circumferential wall 14*c* is partly high. When an internal pressure of the volume chamber 24 changes, since the tapered wall 33 uniting the straight line portion 35 of the mountain portion 31 with the straight line portion 36 of the valley portion 32 moves (shakes or wobbles) with bending points A1 to A4 being centers, the elastic member 14 moves (expands and contracts) basically only in the axial direction. As a consequence, a large amplitude in the axial direction of the elastic member 14 in response to the intake pulsation can be obtained, and a more effective intake sound reduction effect can be obtained. In other words, since a plurality of ring-shaped high rigidity portions are separately arranged in the axial direction and these high rigidity portions are united by the shakable tapered wall 33, a free movement (free expansion and contraction) in the axial direction of the elastic member 14 is allowed while suppressing a displacement in the radial direction of the elastic member 14, then a larger amplitude of the elastic member 14 in response to change of a sound pressure can be obtained.

On the other hand, the end surface wall 21 of the top end 14*b* of the elastic member 14 can produce or bring about the film-vibration in response to the intake pulsation with a joining point with an outer circumferential edge 21*a* of the end surface wall 21, i.e. a tip end of the circumferential wall 14*c*, being a joint or a knot.

As a basic effect or working of the intake sound reduction device 1 configured as above, since the volume chamber 24 set to an appropriate volume is connected to the intake passage of the internal combustion engine via the communication pipe 11 and the branch pipe 5 that are the main pipe, so-called Helmholtz resonant element is formed, and by this resonant effect, an intake sound in a specific frequency band is reduced. Here, the volume etc. of the volume chamber 24 are tuned or adjusted in order to obtain the intake sound reduction effect in a desired frequency band. As an embodiment, the intake sound reduction effect by this Helmholtz resonant element can be obtained in a relatively high frequency region, e.g. around 200~400 Hz, and for instance, noise of a rotation quartic component at 3000~6000 rpm of an in-line four-cylinder engine can be reduced.

Further, at the same time, the intake pulsation is introduced into the volume chamber 24, and this brings about the movement (expansion and contraction) in the axial direction of the elastic member 14. A sound pressure energy is thus converted into a kinetic energy of the elastic member 14. With this, the intake sound reduction effect can be obtained in the specific frequency band. Moreover, the film-vibration of the end surface wall 21 occurs in response to the intake pulsation introduced into the volume chamber 24, then, in the same manner as above, a sound pressure energy is converted into a kinetic energy of the elastic member 14. The intake sound reduction effect can be obtained also by this film-vibration of the end surface wall 21.

That is, in the present embodiment, a first resonance system (a first vibration system) is formed by the movement of the expansion and contraction in the axial direction of the elastic member 14 having the bellows circumferential wall 14*c*, and also a second resonance system (a second vibration system) is formed by the film-vibration of the end surface wall 21. Then, resonance frequencies of the both first and second resonance systems are set to be relatively close to each other, then great reduction of the intake sound by antiresonance between these two resonance frequencies can be obtained.

Figure 6:
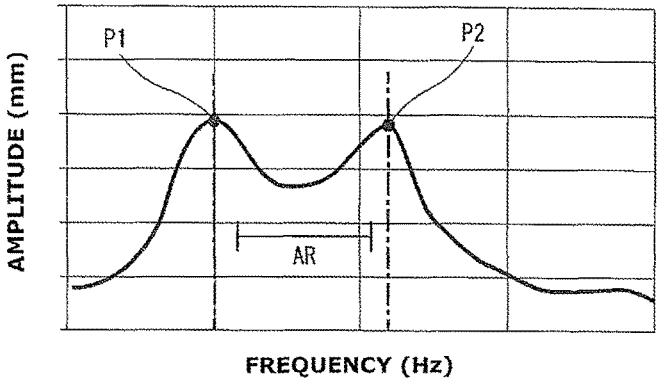
FIG. 6 is an explanatory drawing schematically showing two resonance frequencies and an antiresonance region.

FIG. 6 is a drawing that schematically shows this effect. In FIG. 6, a vertical axis is an amplitude of the elastic member 14, namely an amplitude of the end surface wall 21, and a horizontal axis is frequency (corresponding to a rotation speed of the internal combustion engine). When either one of the resonance frequencies of the first and second resonance systems is a primary resonance frequency P1 and the other is a secondary resonance frequency P2, an antiresonance region AR appears between the both primary and secondary resonance frequencies, and the sound pressure energy is greatly reduced.

In order to obtain an antiresonance effect, it is necessary that the primary resonance frequency P1 and the secondary resonance frequency P2 should be relatively close to each other. As an embodiment, the primary resonance frequency is determined by the first resonance system by the expansion and contraction of the bellows circumferential wall 14*c*, and this primary resonance frequency is set to 30~200 Hz. Further, a peak P2 of the secondary resonance frequency is determined by the second resonance system by the film-vibration of the end surface wall 21, and this secondary resonance frequency is set to 50~300 Hz which is a little higher than the primary resonance frequency. Here, regarding intake pulsation of a rotation secondary component which is noticeable sound in the in-line four-cylinder engine, it is 50 Hz when the rotation speed is 1500 rpm, and it is 100 Hz when the rotation speed is 3000 rpm. Further, a distance or separation between the primary resonance frequency and the secondary resonance frequency is set to 15~200 Hz.

Each of the primary and secondary resonance frequencies can be adjusted properly by changing elasticity (spring constant) of the circumferential wall 14*c* and the end surface wall 21 that correspond to a spring of a spring-mass system and a weight or a thickness of the end surface wall 21 or material of the elastic member 14 which corresponds to a mass of the spring-mass system.

Figure 7A:
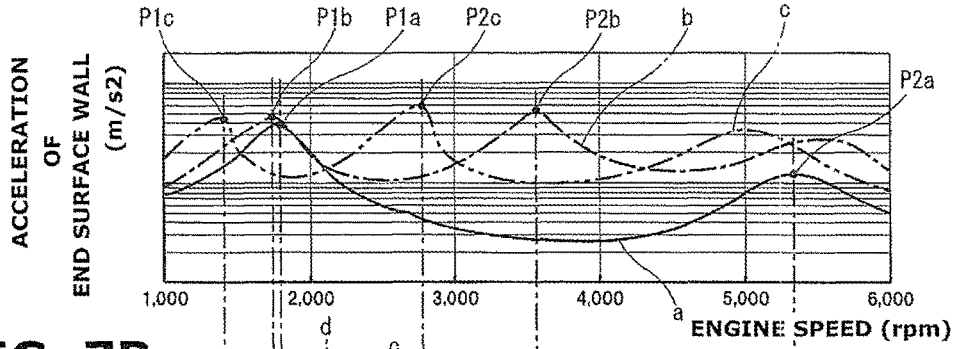
FIG. 7A shows characteristics of acceleration of an end surface wall.
Figure 7B:
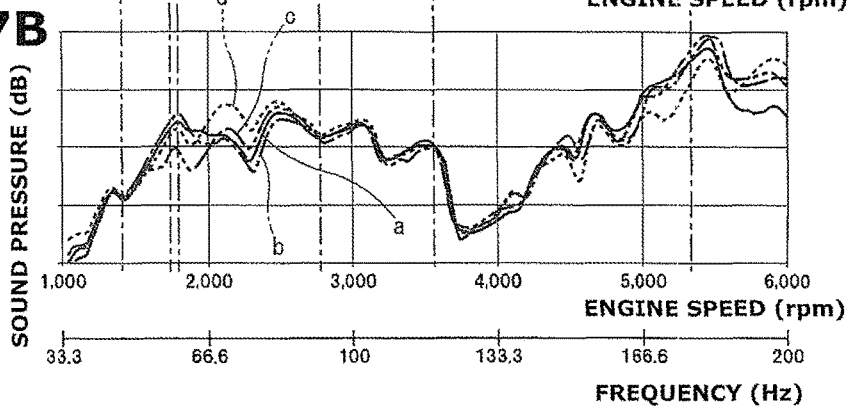
FIG. 7B shows characteristics of sound pressure, of embodiments of the present invention and a comparative example.

FIGS. 7A and 7B show some examples of combination between the primary resonance frequency and the secondary resonance frequency. Horizontal axes are an engine rotation speed and frequency of the rotation secondary component at its rotation speed. Characteristics of acceleration of the end surface wall 21 (FIG. 7A) and characteristics of sound pressure at the outside air introduction port 4*a* (FIG. 7B) are shown with these characteristics put in contrast with each other. Characteristic a is an example in which rigidity of the circumferential wall 14*c* is medium, rigidity of the end surface wall 21 is relatively high, a primary resonance frequency P1*a* by the bellows shape is set to approx. 59 Hz and a secondary resonance frequency P2*a* by the end surface wall 21 is set to approx. 177 Hz. Characteristic b is an example in which rigidity of the circumferential wall 14*c* is medium, rigidity of the end surface wall 21 is medium, a primary resonance frequency P1*b* by the bellows shape is set to approx. 57 Hz and a secondary resonance frequency P2*b* by the end surface wall 21 is set to approx. 119 Hz. Characteristic c is an example in which rigidity of the circumferential wall 14*c* is relatively low, rigidity of the end surface wall 21 is relatively low, a primary resonance frequency P1*c* by the bellows shape is set to approx. 46 Hz and a secondary resonance frequency P2*c* by the end surface wall 21 is set to approx. 92 Hz. Characteristic d in FIG. 7B indicates intake sound characteristics of a case where the intake sound reduction device 1 is not provided.

As is clear from FIG. 7, by configuring the intake sound reduction device 1 so that the elastic member 14 has the primary resonance frequency and the secondary resonance frequency, the intake sound reduction effect can be obtained in the antiresonance region between the two resonance frequencies. For instance, it is possible to effectively reduce the intake sound coming at around 1500~4000 rpm which is a normal rotation speed region of the internal combustion engine. Here, as is clear from comparison between the characteristic a to c, if the two resonance frequencies are relatively close to each other, a silencing effect by the antiresonance can be obtained more strongly. If the two resonance frequencies are separate more than a range (distance or separation) of 200 Hz, the effect of the antiresonance brought by having the two resonance frequencies can hardly be obtained. On the other hand, if the distance or separation between the two resonance frequencies is shorter (narrower) than 15 Hz, there is no big difference from a case where the elastic member 14 has substantially one resonance frequency, and the engine rotation speed of a target of the reduction or silencing of sound cannot be obtained widely. Hence, it is desirable that the distance or separation between the primary resonance frequency and the secondary resonance frequency should be 15~200 Hz.

Next, other embodiments in which a structure of the end surface wall 21 is changed will be explained with reference to FIGS. 8 and 9.

Figure 8:
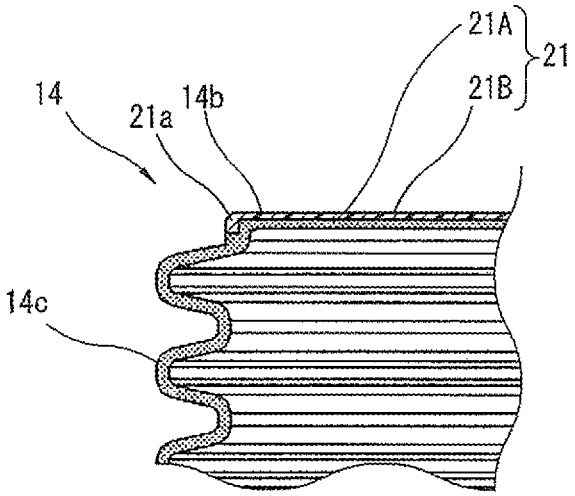
FIG. 8 is a sectional view of a main part of the elastic member, showing the end surface wall having a laminate or layer structure formed by an elastic member layer and a synthetic resin plate.

In an embodiment shown in FIG. 8, the circular plate-shaped end surface wall 21 closing or sealing the top end 14*b* of the bellows elastic member 14 has a double layer structure formed by an inner side layer 21A that is formed integrally with the circumferential wall 14*c* with the same material (e.g. thermoplastic elastomer) as that of the circumferential wall 14*c* and an outer side layer 21B that is a thin synthetic resin plate fixed to an outside surface of the inner side layer 21A. The synthetic resin plate of the outer side layer 21B is integrally fixed to the elastic member 14 by so-called insert molding when molding the elastic member 14. Here, regarding the outer side layer 21B made of relatively hard synthetic resin, its rigidity is higher than those of the inner side layer 21A and circumferential wall 14*c* under the same thickness condition. In order to form the resonance system having a desired resonance frequency as the end surface wall 21, the synthetic resin-made outer side layer 21B is formed relatively thin.

Figure 9:
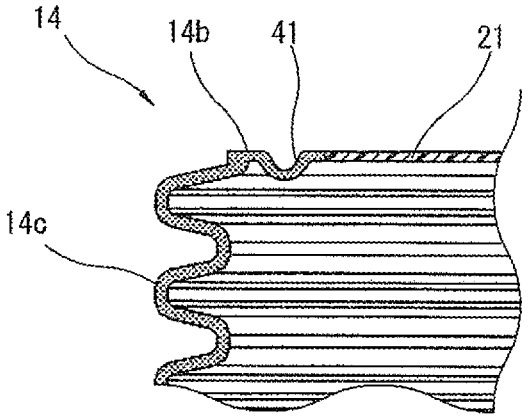
FIG. 9 is a sectional view of a main part of the elastic member, showing the end surface wall formed by a synthetic resin plate.

In an embodiment shown in FIG. 9, the circular plate-shaped end surface wall 21 closing or sealing the top end 14*b* of the bellows elastic member 14 is formed by a relatively hard synthetic resin circular plate whose diameter is smaller than that of the valley portion 32 of the circumferential wall 14*c*, and this synthetic resin circular plate is joined or united with the circumferential wall 14*c* through an edge portion 41 formed at a tip end outer circumferential portion of the elastic material-made circumferential wall 14*c*. The edge portion 41 is formed with the same material (e.g. thermoplastic elastomer) as that of the circumferential wall 14*c* so as to continue from the tip end outer circumferential portion of the circumferential wall 14*c*. The edge portion 41 has a recessed shape such as an arc shape (i.e. C-letter or U-letter shape) in a longitudinal cross section so as to allow displacement in the axial direction of the end surface wall 21. When viewed from above, a shape of the edge portion 41 is a ring-shape, and an entire circumference of the synthetic resin circular plate is supported or retained through the edge portion 41. Therefore, a relatively-high rigid end surface wall 21 moves or vibrates through the edge portion 41 so as to make a parallel displacement in the axial direction. The synthetic resin plate that is the end surface wall 21 is integrally fixed to the elastic member 14 by so-called insert molding when molding the elastic member 14 (in other words, when molding the edge portion 41).

Although the present invention has been explained above, the present invention is not limited to the structure or configuration of the above embodiments. For instance, the structure of the bellows circumferential wall 14*c* of the elastic member 14 is not limited to that shown in FIGS. 4 and 5, and other structure can be used. Further, although the above embodiments show that the intake sound reduction device 1 having the elastic member 14 is connected to the outside air introduction duct 4 of the intake system, the intake sound reduction device 1 could be connected other positions of the intake system.

The entire contents of Japanese Patent Application No. 2015-247481 filed on Dec. 18, 2015 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An intake sound reduction device for an internal combustion engine comprising:

an elastic member formed into a substantially cylindrical shape, the elastic member having an open base end, a top end sealed by an end surface wall, and a bellows circumferential wall;

a base plate retaining the base end of the elastic member; and a communication pipe having one end connected to the base plate such that a volume chamber that is formed inside the elastic member communicates with an intake passage of the internal combustion engine, the intake sound reduction device having a first resonance system formed by expansion and contraction in an axial direction of the elastic member and a second resonance system formed by film-vibration of the end surface wall, wherein when either one of resonance frequencies of the first or second resonance systems is a primary resonance frequency and the other is a secondary resonance frequency, the primary resonance frequency is set to 30-200 Hz and the secondary resonance frequency is set to 50-300 Hz.

2. The intake sound reduction device for the internal combustion engine as claimed in claim 1, wherein:

a separation between the primary resonance frequency and the secondary resonance frequency is set to 15-200 Hz.

3. The intake sound reduction device for the internal combustion engine as claimed in claim 1, wherein:

the end surface wall and the circumferential wall are formed with the same elastic material.

4. The intake sound reduction device for the internal combustion engine as claimed in claim 1, wherein:

the end surface wall is formed by a synthetic resin plate, and the end surface wall is supported at a tip end outer circumferential portion of the circumferential wall made of elastic material through an edge portion that is formed at the tip end outer circumferential portion of the circumferential wall with elastic material and has an arc shape in a longitudinal cross section.

* * * * *